United States Patent [19]

Des Prez

[11] Patent Number: 5,056,820

[45] Date of Patent: Oct. 15, 1991

[54] TIE FOR SKIS AND SKI POLES

[76] Inventor: Victor Des Prez, 177 Riverside Ave., Newport Beach, Calif. 92663

[21] Appl. No.: 495,289

[22] Filed: Mar. 19, 1990

[51] Int. Cl.[5] ..... A63C 11/00

[52] U.S. Cl. ..... 280/814; 280/816

[58] Field of Search ..... 280/814, 816, 820; 224/245, 917

[56] References Cited

U.S. PATENT DOCUMENTS

| | | | |
|---|---|---|---|
| 3,279,008 | 11/1964 | Wallach | 221/245 |
| 3,342,388 | 9/1965 | Duckworth | 221/245 |
| 3,383,738 | 8/1966 | Fox et al. | 221/245 |
| 3,486,672 | 12/1969 | Esopi | 280/814 |
| 3,503,101 | 6/1968 | Kolozsvary | 221/245 |
| 3,543,977 | 12/1970 | Lockridge | 221/245 |
| 3,554,417 | 1/1971 | Yorty | 221/245 |
| 3,626,553 | 8/1970 | Darney et al. | 280/814 |
| 3,841,542 | 10/1974 | Hogensen, Jr. | 280/814 |
| 3,947,927 | 4/1976 | Rosenthal | 280/814 |
| 3,976,234 | 8/1976 | Moudry et al. | 280/814 |
| 4,120,437 | 10/1978 | Hara | 280/414 |
| 4,165,027 | 8/1979 | Briggs | 280/814 |
| 4,377,306 | 3/1983 | Abatecola | 280/814 |
| 4,470,528 | 9/1984 | Dyess | 280/814 |
| 4,494,787 | 1/1985 | Gainey | 280/814 |
| 4,588,115 | 5/1986 | Uyeda | 221/245 |

*Primary Examiner*—Andres Kashnikow
*Assistant Examiner*—Richard Camby
*Attorney, Agent, or Firm*—Arthur Frelich; Robert D. Hornbaker; Leon D. Rosen

[57] ABSTRACT

An apparatus is described for tying together ski poles and skis into a compact package that can be stably carried not only with the poles and skis horizontal, but also when they extend vertically. The tie has a middle (44, FIG. 4), a pair of pole strip end portions (40, 42) extending from one part of the middle for wrapping about a pair of ski poles, and a pair of ski strip end portions (46, 48) extending from an opposite part of the middle for wrapping about a pair of skis. Velcro-type fasteners lie on the outer side of a first end portion and on the inner side of a second end portion of each pair to hold the pair of strips together when wrapped about poles or skis. Each strip end portion is long enough to wrap by an angle (82, 84) of substantially 180° about the poles or skis, and the inner surface of one of the strip end portions is formed of a soft rubbery material (56).

8 Claims, 2 Drawing Sheets

TIE FOR SKIS AND SKI POLES

BACKGROUND OF THE INVENTION

Skiers must often carry a pair of ski poles and a pair of skis when not using them. These four items are most easily carried by tying all of them together into a single package, so a person can grasp the ski poles in his hand and thereby hold them and the skis.

U.S. Pat. No. 3,486,672 by Esopi describes a carrier which includes two ties that each ties one end of the poles and skis together. His device appears to be a molded device of plastic or rubber with buckles for closing over the poles and skis. U.S. Pat. No. 4,120,437 by Hara describes another carrier which includes a pair of ties, each including two pieces of woven fabric with Velcro pads at their ends, with one strip encircling the poles and the other strip encircling the skis. While these two types of carriers are satisfactory for holding the poles and skis together when they extend horizontally, they are not adequate for holding the skis and poles when they extend vertically. The assembly of tied-together skis and poles often have to be transported through doorways and around corners in narrow hallways and corridors, and through crowded rooms, and it is necessary to hold the skis and poles vertically to prevent them from hitting other people or nearby objects. With the poles held in one hand, the weight of the skis on the ties tends to cause the ties and skis to slip downwardly. A carrier such as shown in U.S. Pat. No. 3,486,672 by Esopi cannot be tightly wrapped about both the poles and skis where the spacing of the poles and thickness and width of the skis varies. Furthermore, even where his ties are formed completely of soft rubber, they do not have sufficient firmness to prevent slipping down of the skis or of the ties on the poles. The carrier described in U.S. Pat. No. 4,120,437 by Hara shows a tie that may be sufficiently inelastic to firmly wrap about poles and skis, but which does not provide sufficient friction to prevent downward slipping of the ski when held vertically. A simple and low cost tie which could be quickly held to poles and skis to hold them in a taut assembly, and which prevented the skis and ties from slipping downwardly when the assembly was oriented vertically and only the poles were held, would be of considerable value.

SUMMARY OF THE INVENTION

In accordance with one embodiment of the present invention, a low cost tie is provided for tying ski poles and skis together, in an assembly that remains stable even when carried with the poles and skis extending vertically. The tie has a middle, a pair of pole strip end portions extending from one end or part of the middle for wrapping about a pair of poles, and a pair of ski strip end portions extending from the other part of the middle for wrapping about a pair of skis. A first strip end portion of each pair has an outer side carrying one type of Velcro-type fastener elements, while the other strip end portion of the pair has an inner side with mating Velcro-type fastener elements. The first strip end portion of each pair has a rubbery layer on its inner side, which is located to engage far locations on the ski poles or skis which lie furthest from the middle of the tie. Each strip end portion is long enough to wrap substantially 180° about the far location of the poles or skis. Thus, the strip end portions can be wrapped very tightly about the poles and skis without danger that they will become loosened, while the rubbery layers engaging the poles and skis provide high friction contact therewith to prevent slippage of the skis on the ties or of the ties on the poles.

Each strip end portion has a layer of flexible but nonelastic material holding Velcro-type fastener elements, to avoid elongation that could lead to slippage. A layer of rubbery material is fastened to the inside surface of one of the strips of flexible but nonelastic material. The tie can be formed from two strip members, with a first formed of a long strip of material such as Nylon with Velcro-type fastener elements thereof and with a layer of rubbery material on one face, and with the other strip member formed solely of a strip of material such as Nylon with Velcro fastener elements on one face. The two strips are sewn together at a middle portion, to leave pole strip end portions each of a length of at least 2 ½ inches, and to leave ski strip end portions each of a length of at least 6 inches.

A spacer formed of a strip of rubber can be sewn between the other two strips and extend between the ski strip end portions, to lie between a pair of skis which is wrapped about by the pair of ski strip end portions.

The novel features of the invention are set forth with particularity in the appended claims. The invention will be best understood from the following description when read in conjunction with the accompanying drawings.

DESCRIPTION OF THE PREFERRED EMBODIMENT

Figure 1:
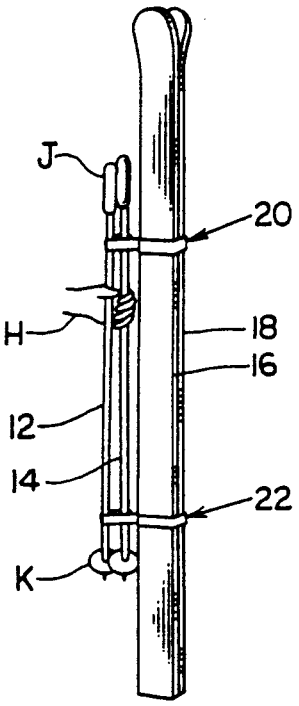
FIG. 1 is a perspective view showing apparatus of the present invention being used to hold a pair of ski poles and skis together in a package, and showing the package being held vertically.

FIG. 1 illustrates a package or assembly 10 which includes a pair of ski poles 12, 14, and a pair of skis 16, 8, with the poles and skis held together by a pair of ties 20, 22. The figure shows the ski poles and skis, or ski members, supported in a vertical orientation by a person's hand H which grasps the poles. The poles or shafts thereof are held so the shafts lie close to one another but are slightly spaced due to the fact that the wide handles J keep the upper ends of the poles separated and the baskets K at the bottoms of the poles keep the bottoms of the shafts separated. It is highly desirable that the skis and ties do not slip downwardly when the assembly is held in the vertical orientation, which is necessary when carrying the package through a doorway or around a curve in a narrow hallway, or when carrying them past a room filled with many people.

Figure 2:
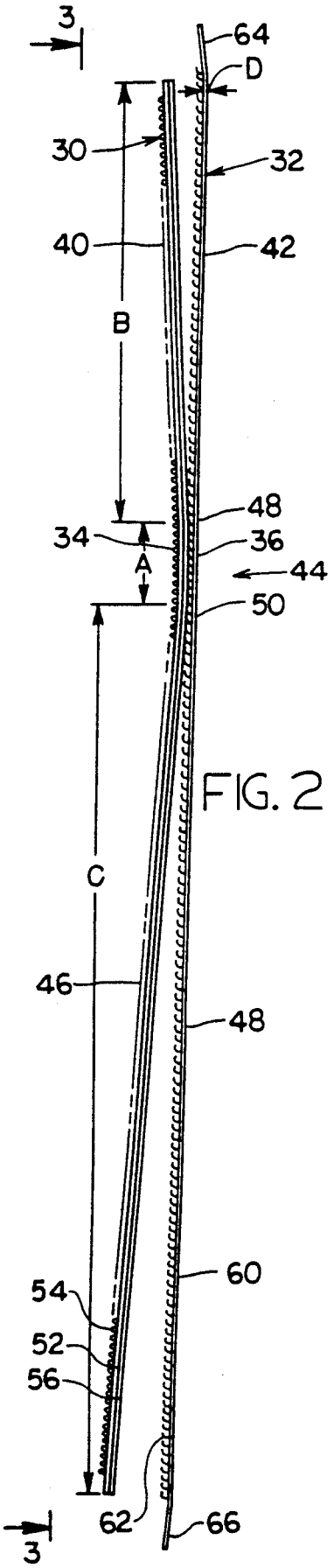
FIG. 2 is a side elevation view of one of the ties of the assembly of FIG. 1, shown prior to installation on ski poles and skis.

The two ties 20, 22 are identical, and one of them 20 is described in detail hereinafter. As shown in FIG. 2, the tie 20 is formed of first and second strip members 30, 32 having middle portions 34, 36 that are fastened together. Each strip member includes a pole end portion 40, 42 extending from one end or part of the middle 44 of the tie, for wrapping about a pair of ski poles. Each strip member also includes a pair of ski end portions 46, 48 extending from the opposite end or part 50 of the middle of the tie, for wrapping about a pair of skis.

Figure 3:
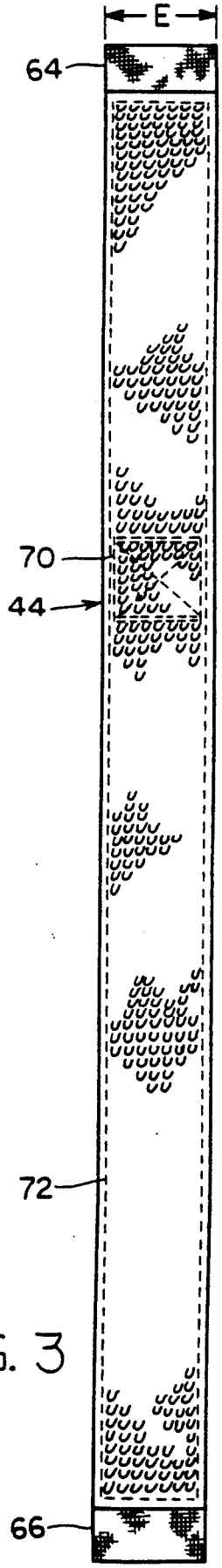
FIG. 3 is a view taken on the line 3—3 of FIG. 2.

The first strip member 30 is formed from a strip 52 of flexible but nonelastic material such as Nylon which has Velcro-type fastener elements 54 on its outer face, which faces away from the other strip member. The first strip member also includes a strip or layer 56 of a soft rubbery material such as rubber of a duramater hardness of about 50 to 60, i.e. about 55. The second strip member is formed of a layer or strip 60 of the same material as the strip 52, of flexible but nonelastic material such as Nylon, and has Velcro-type fastener elements 62 of the hook type that fasten to the loop type 54 on the other strip member. The second strip member has tabs 64, 66 in its opposite ends that are devoid of the fastener elements to facilitate removal of the tie. As shown in FIG. 3, the two strip members are held together by sew lines 70 at the middle of the tie. The strip 52 and rubbery layer 56 of the first strip member are held together at sew lines 72 and also by adhesive.

Figure 4:
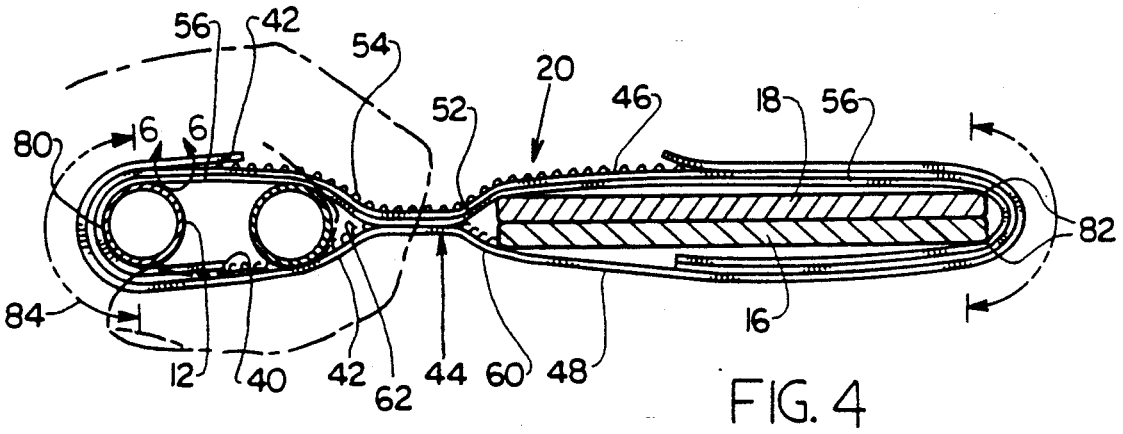
FIG. 4 is a sectional view of the assembly of FIG. 1, showing the tie of FIG. 2 in a use position with ski poles and skis.

FIG. 4 illustrates the manner in which the tie 20 is installed on the pair of ski poles and the pair of skis. Initially, the first pole strip end portion 40 is wrapped about the pair of poles and then the second pole strip end portion 42 is wrapped tightly about the first strip end portion. The mating Velcro fastener elements 54, 62 fasten the pole strip end portions tightly together about the poles, with the rubbery layer 56 directly engaging both poles, and especially a far location 80 of the ski pole 12 that lies furthest from the middle 44 of the tie.

In a next step, the tie is installed on the skis 16, 18 by first wrapping the first ski strip end portion 46 about the skis while they lie facewise against or adjacent to one another. Then the second ski strip end portion 48 is wrapped tightly about the first end portion, so the Velcro elements 54, 62 fasten to each other. As in the case for the pole end portions, the layer of soft rubber 56 lies tightly against far locations 82 of the skis which are the locations furthest from the middle 44 of the tie.

The pole strip end portions 40, 42 are each long enough, that each extends in a substantially 180° loop 84 around the far location 80 of the poles. This results in the second pole strip end portion 42, which has been tightly wrapped about the other pole end portion, pressing the soft rubber layer 56 against the pole 12 along an angle of about 180°, to assure tight wide-area contact of the rubber layer with the pole 12. Also, this results in the Velcro-type fastener elements on the two pole end portions engaging along a substantially 180° loop, so the Velcro-type fasteners do not slip on one another despite tight fastening.

Figure 5:
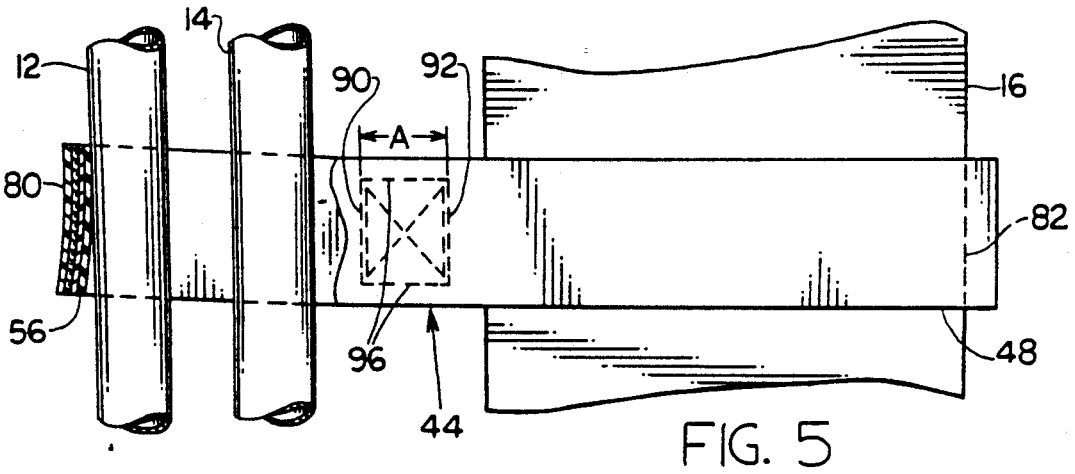
FIG. 5 is a partial sectional side view of the assembly of FIG. 4.
Figure 6:
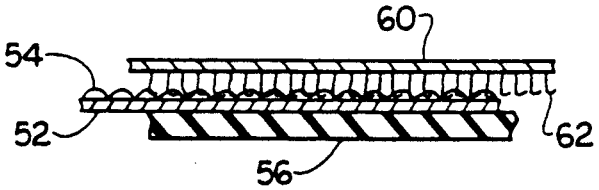
FIG. 6 is an enlarged view of the area 6—6 of FIG. 4.

The fact that the strips 52, 60 which bear the Velcro-type fasteners are of a flexible but inelastic material such as Nylon, results in their maintaining the rubber layer tight against the ski pole after a person initially wraps the end portions. As shown in FIG. 5, when the vertical poles are supported by the hand, the skis such as 16 and the ski end portions such as 48 of the tie tend to sag. This merely results in the upper portion of the far location 80 of the rubber layer 56 being pressed more tightly against the ski pole 12. The result is very high friction of the rubber layer with the ski pole, which greatly resists downward slipping of the tie along the ski poles. Similarly, at the skis, the rubber layer at the far location 82 is pressed even more tightly against the outer edges of the skis to firmly grip them and avoid downward sliding of the skis. As mentioned above, it is a relatively simple matter to tie a pair of ski poles and skis together if they are to remain horizontal, but it is much more difficult to provide a secure assembly if the skis and poles are to be often held in a vertical orientation. The construction of the tie, which allows the rubber layer to be pressed firmly against the ski poles and skis along a considerable angle of wrap, and to resist loosening, results in increased pressure of the rubber layer against the ski poles and skis when they are held vertically, which results in great resistance to downward sliding of the ties and/or skis.

The coefficient of friction of rubber against materials such as steel is about 0.2, which is higher than most other materials. The use of soft rubber results in wide area of contact of the rubber layer with the ski poles and skis, to provide reliable frictional contact. The fact that the rubber layer is backed up by flexible but nonelastic material such as Nylon, results in resistance to outward deflection of the rubber which could allow the ski poles and skis to slide. The wide angle (about 180°) of contact of the rubber with the poles and skis, and the wide angle of fastening of the end portions at their Velcro-type fasteners results in great resistance to sliding of the Velcro fasteners on one another which could result in loosening of the tie.

As shown in FIG. 5, the middle 44 of the tie has first and second main sew lines 90, 92 where the two strip members are sewn together. A very strong thread is used to withstand the large force tending to separate the strip members as the sew lines. Additional sew lines 96 connect the main sew lines, with the additional sew lines including two extending parallel to the length of the strip member and two others making an X. The additional sew lines support the main sew lines, as the threads tend to separate slightly. The length A of the sewn-together middle is at least about ½ inch, to provide room for a person to project his fingers between the pair of ski poles and the skis.

Figure 7:
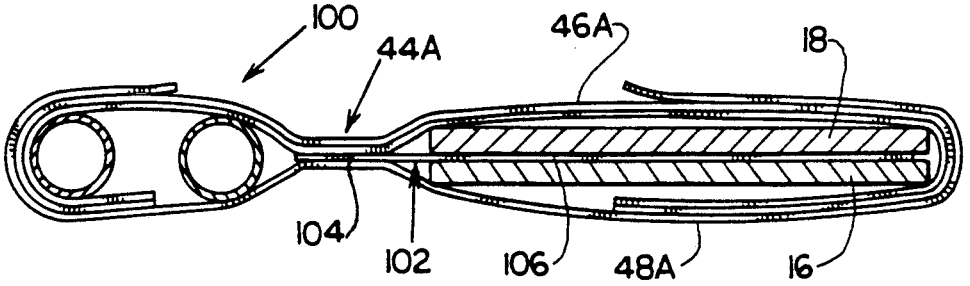
FIG. 7 is a sectional view of an assembly similar to that of FIG. 4, but showing a tie constructed in accordance with another embodiment of the present invention.

FIG. 7 illustrates another tie 100 which is identical to that of FIG. 4, except that the tie includes a separator strip 102. The separator strip 102 is preferably formed of a soft rubber layer, and has one portion 104 sewn into the middle 44A of the tie, and has an end portion 106 which projects between the skis 16, 18. The rubbery strip 102 slightly separates the skis to prevent them from rubbing on one another and becoming scratched. The end portion 106 of the separator strip is preferably less than the length of the ski end portions 46A, 48A, so it does not have a portion extending beyond the skis, which would interfere with tight wrapping of the end portions 46A, 48A about the skis and about one another.

In a tie that applicant has constructed and successfully tested, the middle portion had a length A (FIG. 2) of ⅜th inch, a ski pole end portion of length B of 3 ¾ inches, a ski end portion of length C of 7 ½ inches, a thickness D of the Nylon layers 52, 60 each 12 thousanths inch, and a width E (FIG. 3) of 1 inch. Although the strip members could be round instead of thin ad wide, there are disadvantages in using a round strip in that it is difficult to attach and mate Velcro-type fastener elements.

Thus, the invention provides apparatus for tying a pair of ski poles and a pair of skis together, which securely holds them together even when the poles and skis extend vertically and only the poles are held by the hand of a skier. The apparatus includes a tie with a pair of pole strip end portions that can wrap about a pair of ski poles and a pair of ski strip end portions that can wrap about a pair of skis. A first strip end portion of each pair has Velcro-type fastener elements on its outer side and a soft rubbery layer on its inner side, and the other strip end portion has mating Velcro-type fasteners on its inner side. The strip end portions are long enough that each can wrap completely about a far location, of a pair of poles or of a pair of skis, which lie furthest from the middle of the tie, to extend in a substantially 180° loop. The length which results in such a large angle of wrap, results in the soft rubbery layer being held very securely against the poles and skis to provide wide high friction contact that minimizes the possibility of slipping when the poles and skis extend vertically. The Velcro fasteners preferably lie on strips of flexible but nonelastic material, so when the end portions are tightly wrapped about the poles and skis, they resist deflection, but instead keep the rubber layer pressed tightly against the poles and the skis.

Although particular embodiments of the invention have been described and illustrated herein, it is recognized that modifications and variations may readily occur to those skilled in the art, and consequently, it is intended that the claims be interpret<d to cover such modifications and equivalents.

I claim:

1. Apparatus for tying together a pair of ski poles and a pair of skis, wherein the pair of skis have approximately a predetermined width, have ski surfaces that lie facewise adjacent, and have two pairs of opposite ski edges, and the poles lie at approximately a predetermined spacing from each other and from said skis when the poles and skis are pressed together to be carried as a unit comprising:

a tie having a middle with opposite middle parts, said tie having a pair of pole strip end portions extending from one of said middle parts and wrapping about said pair of ski poles, said tie having a pair of ski strip end portions extending from the other one of said middle parts and wrapping about said pair of skis;

said pair of pole strip end portions including a first pole strip end portion having an outer side with first Velcro-type fastener elements, and including a second pole strip end portion having an inner side with second Velcro-type fastener elements, said pole strip end portions being positioned so at least one of them is wrapped about said poles and some of said first and second fastener elements are engaged with each other;

said pair of ski strip end portions including a first ski strip end portion having an outer side with first Velcro-type fastener elements, and including a second ski strip end portion having an inner side with second Velcro-type fastener elements, said ski strip end portions being wrapped about far locations on a pair of said ski edges that lie furthest from said middle;

said first ski strip end portion having a rubbery layer of soft rubber-like material on its inner side which engages said far location on said ski edges with said Velcro-type fasteners of said ski end portions extending far enough from said middle so they engage each other along a pair of said ski edges and along opposite sides of said skis.

2. The apparatus described in claim 1 wherein:

each of said first strip end portions includes a flexible but nonelastic layer holding Velcro-type fastener elements, and said rubbery layers are each fastened to a side of the nonelastic layer opposite the Velcro-type elements thereon.

3. The apparatus described in claim 1 wherein:

said tie includes a first strip member forming one of said strip end portions of each of said pairs, and a second strip member forming the other of said strip end portions of each of said pairs, said strip members each being substantially uniform along its length and being sewn together to form said middle.

4. The apparatus described in claim 3 wherein:

said strip members are sewn together along two main sew lines spaced at least one half inch apart along the length of said strip member, and along a pair of additional sew lines connecting said main sew lines.

5. The apparatus described in claim 1 including:

a separator strip extending from said tie middle for lying between said ski end portions, to lie between said skis.

6. The apparatus described in claim 5 wherein:

said separator strip is of smaller length than either of said ski end portions.

7. The apparatus described in claim 1 wherein:

said pole end portions are each at least 2 ½ inches long, and said ski end portions are each at least 6 inches long, whereby to assure that each end portion wraps in a 180° loop respectively about the poles and skis.

8. The apparatus described in claim 1 wherein:

said middle has a length of approximately ⅝th inch, whereby to allow the fingers of a hand holding the poles to lie between the poles and skis.

* * * * *